US009951573B2

(12) United States Patent
Dahl et al.

(10) Patent No.: US 9,951,573 B2
(45) Date of Patent: Apr. 24, 2018

(54) WHIPSTOCK AND DEFLECTOR ASSEMBLY FOR MULTILATERAL WELLBORES

(71) Applicant: Halliburton Energy Services, Inc., Houston, TX (US)

(72) Inventors: Espen Dahl, Stavanger (NO); Stuart Alexander Telfer, Stonehaven (GB); Peder Bru, Bryne (NO); Frode Lindland, Sandnes (NO)

(73) Assignee: Halliburton Energy Services, Inc., Houston, TX (US)

( * ) Notice: Subject to any disclaimer, the term of this patent is extended or adjusted under 35 U.S.C. 154(b) by 11 days.

(21) Appl. No.: 14/782,880

(22) PCT Filed: May 7, 2015

(86) PCT No.: PCT/US2015/029594
§ 371 (c)(1),
(2) Date: Oct. 7, 2015

(87) PCT Pub. No.: WO2015/187297
PCT Pub. Date: Dec. 10, 2015

(65) Prior Publication Data

US 2016/0145956 A1 May 26, 2016

Related U.S. Application Data

(60) Provisional application No. 62/007,625, filed on Jun. 4, 2014.

(51) Int. Cl.
*E21B 7/06* (2006.01)
*E21B 23/01* (2006.01)
(Continued)

(52) U.S. Cl.
CPC ..... *E21B 23/01* (2013.01); *E21B 7/061* (2013.01); *E21B 23/002* (2013.01); *E21B 29/06* (2013.01); *E21B 43/10* (2013.01)

(58) Field of Classification Search
CPC ..... E21B 7/061; E21B 23/002; E21B 23/01; E21B 29/06; E21B 43/10
See application file for complete search history.

(56) References Cited

U.S. PATENT DOCUMENTS 5,311,936 A * 5/1994 McNair ..... E21B 7/061 166/117.6
5,454,430 A 10/1995 Kennedy et al.
(Continued)

FOREIGN PATENT DOCUMENTS

CN 101855421 A 10/2010
CN 103597165 A 2/2014
(Continued)

OTHER PUBLICATIONS

International Search Report and Written Opinion for PCT/US2015/029594 dated Aug. 26, 2015.
(Continued)

*Primary Examiner* — Matthew R Buck
(74) *Attorney, Agent, or Firm* — McDermott Will & Emery LLP

(57) ABSTRACT

A method includes conveying a whipstock and a latch anchor into a parent wellbore, the latch anchor being attached to the whipstock at a releasable connection and the parent wellbore being lined with casing that includes a latch coupling. The latch anchor is secured to the latch coupling and the whipstock is then separated from the latch anchor at the releasable connection and thereby exposing a portion of the releasable connection. The whipstock is then removed from the parent wellbore and a completion deflector is subsequently conveyed into the parent wellbore in combination with lateral tubing (with or without a multilateral junction positioned thereabove), and the completion deflector is attached to the latch coupling at the releasable con-
(Continued)

nection. The lateral tubing (with or without multilateral junction positioned thereabove) is then installed to correct depth.

19 Claims, 13 Drawing Sheets

(51) Int. Cl.

| | |
|---|---|
| ***E21B 23/12*** | (2006.01) |
| ***E21B 29/06*** | (2006.01) |
| ***E21B 43/10*** | (2006.01) |

(56) References Cited

U.S. PATENT DOCUMENTS

| | | | | | |
|---|---|---|---|---|---|
| 5,526,880 | A * | 6/1996 | Jordan, Jr. | E21B 33/16 | 166/291 |
| 5,845,710 | A * | 12/1998 | Longbottom | E21B 7/061 | 166/117.6 |
| 5,954,134 | A * | 9/1999 | Longbottom | E21B 7/061 | 166/117.5 |
| 6,073,691 | A | 6/2000 | White | | |
| 6,079,493 | A * | 6/2000 | Longbottom | E21B 23/002 | 166/117.6 |
| 6,089,320 | A * | 7/2000 | Lagrange | E21B 41/0042 | 166/117.5 |
| 6,209,644 | B1 * | 4/2001 | Brunet | E21B 41/0042 | 166/117.6 |
| 6,883,611 | B2 * | 4/2005 | Smith | E21B 43/103 | 166/117.6 |
| 6,907,930 | B2 * | 6/2005 | Cavender | E21B 41/0042 | 166/242.3 |
| 8,220,547 | B2 * | 7/2012 | Craig | 166/177.5 | |
| 8,286,708 | B2 * | 10/2012 | Assal | | |
| 2003/0192717 | A1 | 10/2003 | Smith et al. | | |

FOREIGN PATENT DOCUMENTS

| | | | |
|---|---|---|---|
| EP | 0664372 | A2 | 7/1995 |
| GB | 2293186 | A | 3/1996 |
| RU | 2514048 | C1 | 4/2014 |
| WO | WO-94/29562 | A1 | 12/1994 |
| WO | 2015187297 | A1 | 12/2015 |

OTHER PUBLICATIONS

Exended European Search Report from European Patent Application No. 15803813.3 dated Oct. 2, 2010, 8 pages.

Australian Office Action from Australian Patent Application No. 2015268790 dated Oct. 5, 2017, 3 pages.

Russian Decision on Granting from Russian Patent Application No. 2016136849/03, dated Feb. 1, 2018, 19 pages.

* cited by examiner

WHIPSTOCK AND DEFLECTOR ASSEMBLY FOR MULTILATERAL WELLBORES

BACKGROUND

Wellbores are typically drilled using a drill string with a drill bit secured to its lower free end and then completed by positioning a casing string within the wellbore and cementing the casing string in position. In recent years, technology has been developed which allows an operator to drill what may be alternately referred to as either a primary or parent wellbore, and subsequently drill what may be alternately referred to as either a secondary or lateral wellbore that extends from the parent wellbore at a desired orientation and to a chosen depth. The parent wellbore is first drilled and then may be at least partially lined with a string of casing. The casing is subsequently cemented into the wellbore by circulating a cement slurry into the annular regions between the casing and the surrounding formation wall. The combination of cement and casing strengthens the parent wellbore and facilitates the isolation of certain areas of the formation behind the casing for the production of hydrocarbons to an above ground location at the earth's surface where hydrocarbon production equipment is located. In many instances, the parent wellbore is completed at a first depth, and is produced for a given period. Production may be obtained from various zones by perforating the casing string.

At a later time, or while the parent wellbore is being drilled and completed, it is often desirable to drill a lateral wellbore from the parent wellbore. To accomplish this, a casing exit or "window" must be created in the casing of the parent wellbore. The window can be formed by positioning a whipstock in the casing string at a desired location in the parent wellbore. The whipstock is used to deflect one or more mills laterally (or in an alternative orientation) relative to the casing string and thereby penetrate part of the casing to form the window. A drill bit can be subsequently inserted through the window in order to drill the lateral wellbore to the desired length, and the lateral wellbore can then be completed as desired.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates generally to completing wellbores in the oil and gas industry and, more particularly, to a trip saving whipstock and completion deflector system used to complete one or more legs of a multi-lateral well.

The embodiments described herein may improve the efficiency of drilling and completing multi-lateral wellbores, and thereby improve or maximize production of each lateral or secondary wellbore extending from a parent or parent wellbore. More specifically, the efficiency of the multi-lateral junction systems described herein is increased by reducing the downhole trip requirements for installing and using the equipment described herein. According to the embodiments described herein, a whipstock and a latch anchor can be conveyed into a parent wellbore lined at least partially with casing that includes a latch coupling. The latch anchor may be coupled to the whipstock at a releasable connection and secured within the parent wellbore by mating a latch profile of the latch anchor with the latch coupling. The whipstock may be separated from the latch anchor at the releasable connection with a whipstock retrieval tool and thereby expose a portion of the releasable connection. After the whipstock is removed from the parent wellbore, a completion deflector is then conveyed into the parent wellbore and coupled to the latch coupling at the releasable connection. In some cases, the completion deflector is installed in conjunction with a lateral completion, which can be subsequently detached from the completion deflector and advanced into a lateral wellbore.

FIGS. 1-8 are progressive cross-sectional side views of the construction of an exemplary well system 100 that may employ the principles of the present disclosure. Similar numbers used in any of FIGS. 1-8 refer to common elements or components. FIGS. 9A-9B and 10A-10B are alternative embodiments of the well system 100, and similar numbers used in any of FIGS. 9A-9B and 10A-10B also refer to common elements or components from FIGS. 1-8 and, therefore, may not be described again.

Figure 1:
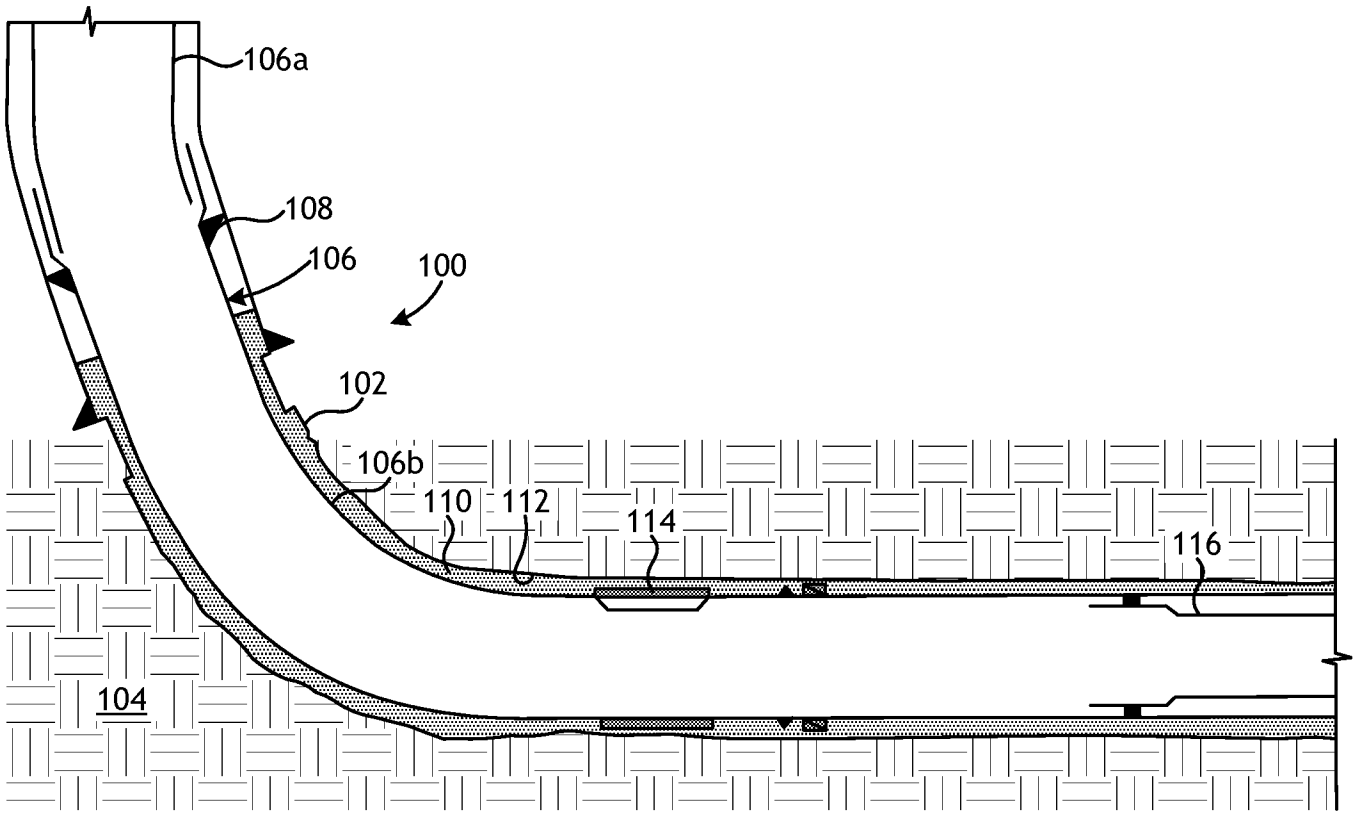
FIG. 1, illustrated is a cross-sectional side view of a well system that may employ from the principles of the present disclosure.

Referring first to FIG. 1, illustrated is a cross-sectional side view of the well system 100 that may employ the principles of the present disclosure. As illustrated, the well system 100 may include a parent wellbore 102 that is drilled though various subterranean formations, including formation 104, which may comprise a hydrocarbon-bearing formation. Following drilling operations, the parent wellbore 102 may be completed by lining all or a portion of the parent wellbore 102 with liner or casing 106, shown as a first string of casing 106*a* and a second string of casing 106*b* that extends from the first string of casing 106*a*. The first string of casing 106*a* may extend from a surface location (i.e., where a drilling rig and related drilling equipment is located) or from an intermediate point between the surface location and the formation 104, and the second string of casing 106*b* may extend from or is otherwise hung off the first string of casing 106*a* at a liner hanger 108. For purposes of the present disclosure, the first and second strings of casing 106*a,b* will be jointly referred to herein as the casing 106. All or a portion of the casing 106 may be secured within the parent wellbore 102 by depositing cement 110 within the annulus 112 defined between the casing 106 and the wall of the parent wellbore 102.

In some embodiments, the casing 106 may have a pre-milled window 114 defined therein. The pre-milled window 114 may be covered with a millable or soft material that may be milled out or otherwise penetrated to provide a casing exit used to form a lateral wellbore extending from the parent wellbore 102. In other embodiments, however, the pre-milled window 114 may be omitted from the well system 100 and the wall of the casing 106 at the location of the pre-milled window 114 may instead be milled through to create the desired casing exit.

After the casing 106 has been cemented, a lower liner 116 may be extended into the parent wellbore 102 and secured to the inner wall of the casing 106 at a predetermined location downhole from the pre-milled window 114 or otherwise where the casing exit is to be formed. While not shown, the lower liner 116 may include at its distal end various downhole tools and devices used to extract hydrocarbons from the formation 104, such as well screens, inflow control devices, sliding sleeves, valves, etc. Moreover, in some embodiments, the lower liner 116 may be coupled to one or more lateral wellbores (not shown) constructed downhole from the pre-milled window 114 and extending from the parent wellbore 102 at a variety of angular orientations.

Figure 2:
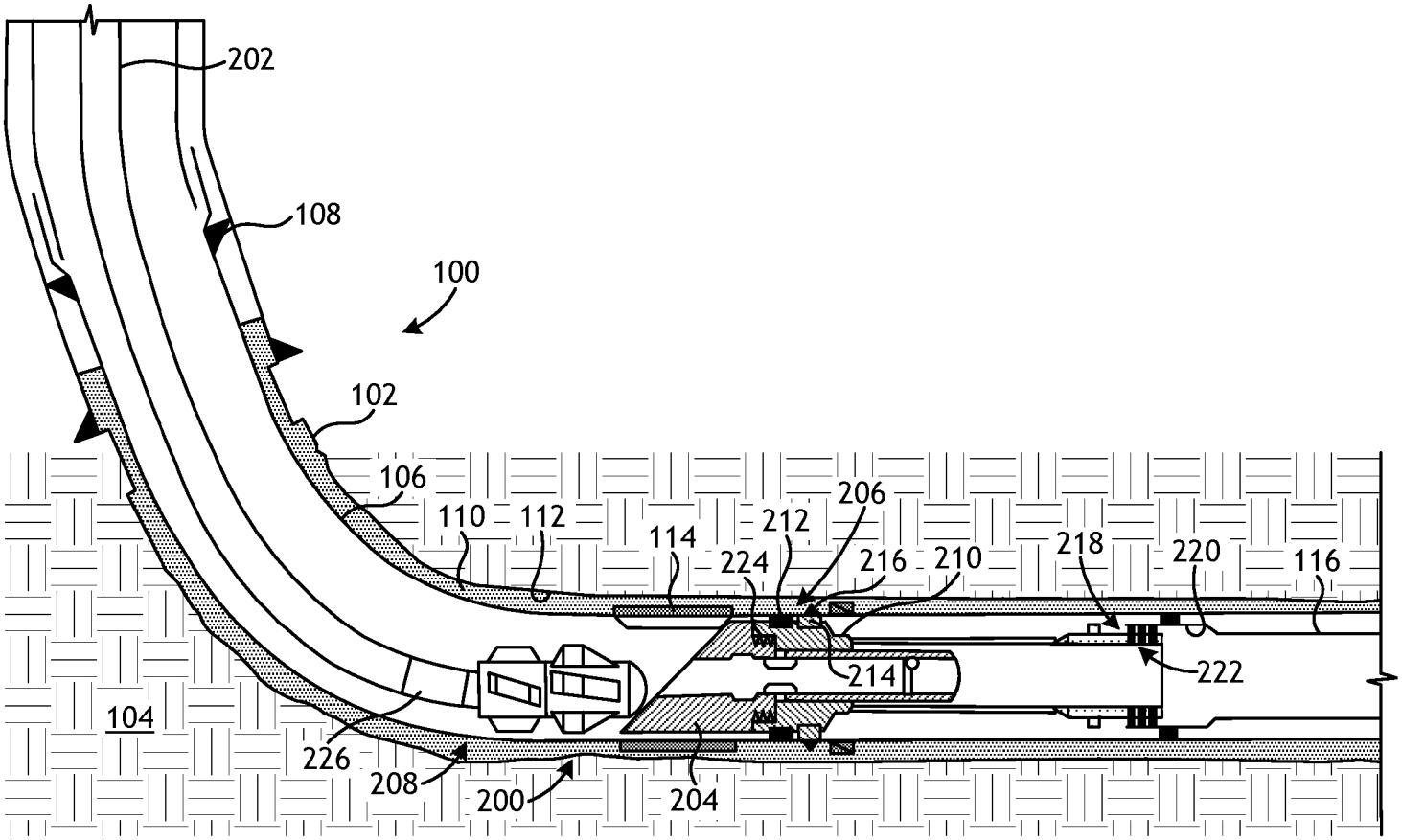
FIG. 2 depicts a cross-sectional side view of an exemplary whipstock and deflector assembly.

Referring to FIG. 2, once the parent wellbore 102 is completed, a whipstock and deflector assembly 200 is conveyed into the parent wellbore 102 on a drill string 202, which may comprise a plurality of drilling tubulars coupled together end-to-end. As illustrated, the whipstock and deflector assembly 200 (hereafter "the assembly 200") may include a whipstock 204 operatively coupled to a latch anchor 206. The whipstock 204 comprises a ramped surface configured to engage and urge one or more mills 208 into the wall of the casing 106 to mill out the casing exit. The mills 208 may be coupled to the whipstock 204 with, for example, a torque bolt (not shown) that allows the drill string 202 to apply torque to the assembly 200 as it is run downhole to the target location. Once the torque bolt is sheared or otherwise fails, the mills 208 may then be free to mill through the pre-milled window 114 to create the casing exit.

The latch anchor 206 may include a latch housing 210, a seal 212, and a latch profile 214 configured to mate with a latch coupling 216 installed in the casing 106 at a predetermined location. As the assembly 200 is lowered into the parent wellbore 102, the latch profile 214 locates in the latch coupling 216 and thereby secures the assembly 200 in place within the parent wellbore 102. The latch anchor 206 is able to orient subsequent assemblies to the same predetermined angular orientation relative to the pre-milled window 114. For instance, the latch anchor 206 may include one or more lugs, guide channels, J-channels, gyroscopes, positioning sensors, actuators, etc., that may be used to help orient subsequent assemblies to the desired angular orientation. The seal 212 may be engaged and otherwise activated to prevent fluid migration across the latch anchor 206 at the interface between the latch housing 210 and the inner wall of the casing 106.

The assembly 200 may further include a lower stinger assembly 218 that extends from the latch anchor 206 and is configured to be received within a seal bore 220 of the lower liner 116. As illustrated, the lower stinger assembly 218 may include one or more seals 222 configured to sealingly engage the inner wall of the seal bore 220, and thereby provide fluid and/or hydraulic isolation with the lower liner 116.

The whipstock 204 may be operatively coupled to the latch anchor 206 via a releasable connection 224 that allows the whipstock 204 to be subsequently separated from the latch anchor 206 and retrieved to the surface, as described in more detail below. The releasable connection 224 may comprise any connection mechanism or device that can be repeatedly locked and released as desired, but also maintains both depth and orientation datums relative to the latch coupling 216 when initially installed.

In some embodiments, the releasable connection 224 may comprise a collet or collet device. In other embodiments, however, the releasable connection 224 may comprise a latching profile, such as a lug-style receiving head with scoop guide. One suitable latching profile is the RATCH-LATCH® device available from Halliburton Energy Services of Houston, Tex., USA. In yet other embodiments, the releasable connection 224 may comprise a threaded engagement and the whipstock 204 may be detached from the latch anchor 206 by rotating the drill string 202 and the whipstock 204 in a specific rotational direction to unthread the coupled engagement.

With continued reference to FIG. 2, exemplary operation of running the assembly 200 into the parent wellbore 102 is now provided. In some embodiments, the drill string 202 may include a measurement-while-drilling ("MWD") tool 226 used to orient the assembly 200 within the parent wellbore 102 and help locate the latch coupling 216. The MWD tool 226 may include one or more sensors that help confirm the angular orientation of the assembly 200, and thereby help ensure that the whipstock 204 and the mills 208 are properly oriented relative to the pre-milled window 114 to form the casing exit.

As the assembly 200 advances to the target location, the lower stinger assembly 218 may be received into the seal bore 220 and thereby provide fluid and/or hydraulic isolation between the casing 106 and the lower liner 116. The latch anchor 206 may also "latch into" and otherwise become secured to the latch coupling 216 once the latch profile 214 locates and mates with the latch coupling 216. As indicated above, the latch anchor 206 may also be configured to orient the assembly 200 to a predetermined angular orientation relative to the pre-milled window 114. Once the latch anchor 206 is secured to the latch coupling 216, the mills 208 may then be detached from the whipstock 204. This may be accomplished by placing an axial load on and shearing the torque bolt (not shown) that couples the mills 208 to the whipstock 204. The mills 208 are then free to move with respect to the whipstock 204 as manipulated by axial movement of the drill string 202.

Figure 3:
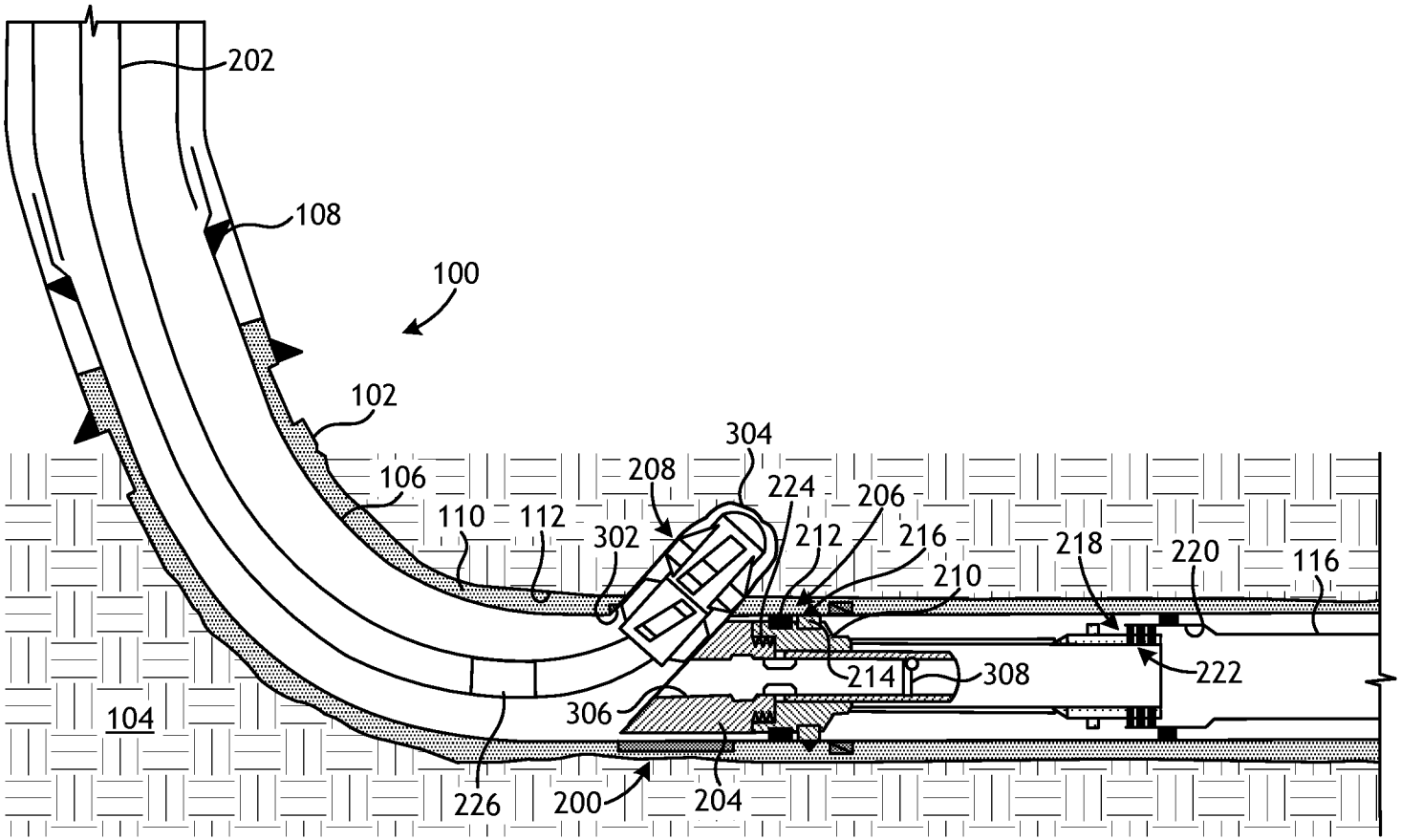
FIG. 3 depicts the creation of a casing exit by moving the mills into engagement with the casing.

Referring to FIG. 3, the drill string 202 may then move the mills 208 in the downhole direction relative to the whipstock 204, which urges the mills 208 to ride up the ramped surface of the whipstock 204 and deflect into engagement with the wall of the casing and, more particularly, into contact with the pre-milled window 114. Rotating the mills 208 via the drill string 202 will mill out the pre-milled window 114 and thereby create a casing exit 302 in the casing 106 and the start to a lateral wellbore 304 that extends from the parent wellbore 102.

As illustrated, the whipstock 204 may define and otherwise provide an inner bore or whipstock bore 306 for running and retrieval tools to be installed. A diameter of the whipstock bore 306 may be smaller than a diameter of the mills 208 (i.e., the lead mill positioned at the distal end of the drill string 202), whereby the mills 208 may be prevented from entering the whipstock bore 306 but are instead forced to ride up the ramped surface of the whipstock 204 and into engagement with the wall of the casing 106. Advantageously, the assembly 200 may include one or more fluid loss control devices 308, such as a flapper valve or a ball valve, located downhole from the whipstock bore 306 and used to isolate lower portions of the parent wellbore 102 from debris resulting from milling the casing exit 302. The fluid loss control device 308 may also prevent fluid loss into the lower portions of the parent wellbore 102 while milling the casing exit 302 and drilling the lateral wellbore 304.

Figure 4:
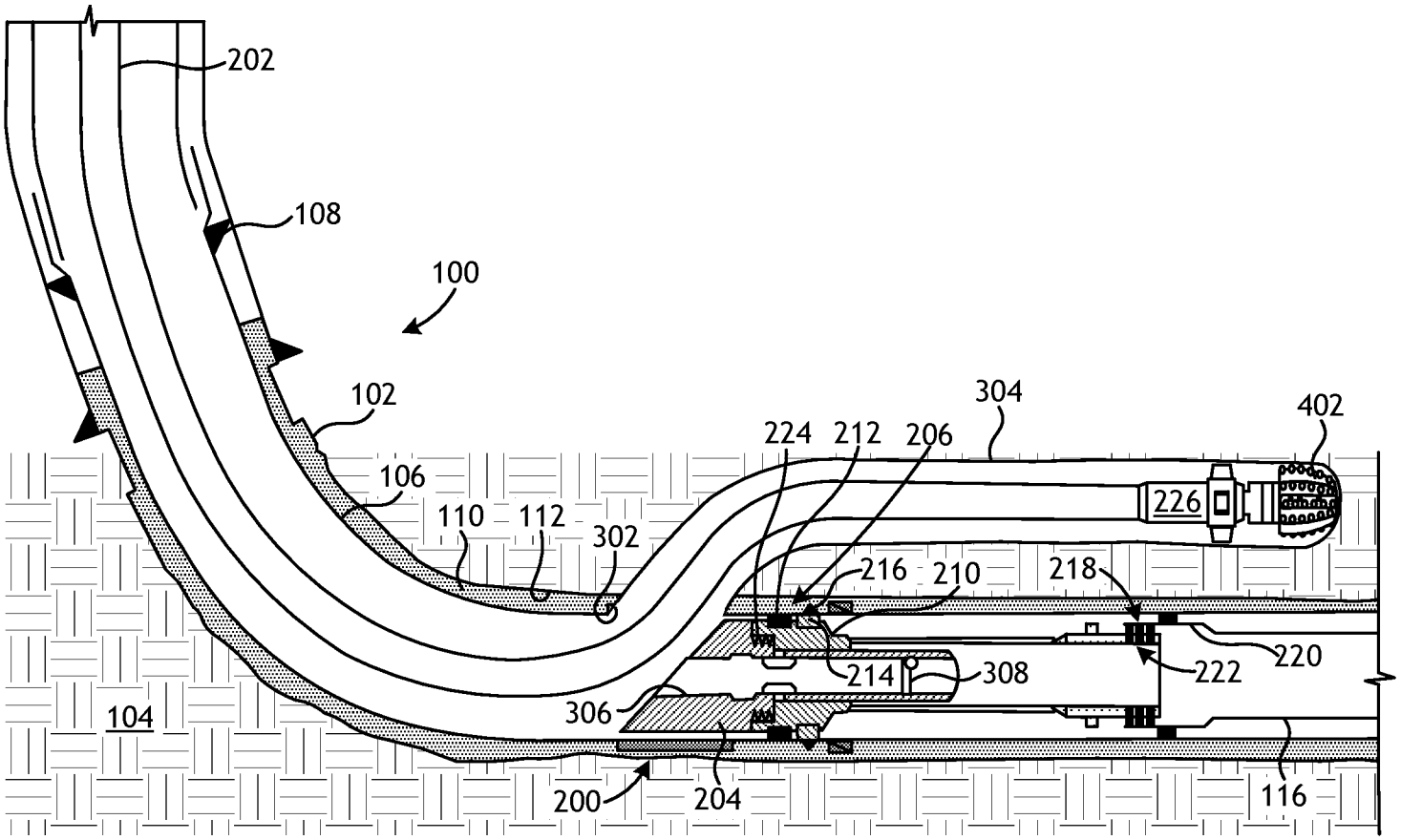
FIG. 4 depicts a lateral wellbore being drilled.

Referring now to FIG. 4, once the casing exit 302 is created, the mills 208 (FIGS. 2 and 3) may be retrieved and otherwise returned to surface and the drill string 202 may subsequently be conveyed back into the parent wellbore 102 with a drill bit 402 installed at its distal end. Similar to the mills 208, the drill bit 402 may exhibit a diameter that is greater than the diameter of the whipstock bore 306 and, as a result, upon encountering the whipstock 402, the drill bit 402 may be forced to ride up the ramped surface of the whipstock 204, through the casing exit 302, and into the start of the lateral wellbore 304. Once in the lateral wellbore 304, the drill bit 402 may be rotated and advanced to drill the lateral wellbore 304 to a desired length or depth. In some embodiments, the MWD tool 226 may be used to monitor drilling operations and help determine when the desired length or depth of the lateral wellbore 304 is achieved. Once the lateral wellbore 304 is drilled, the drill string 202 and the drill bit 402 may be pulled back into the parent wellbore 102 and retracted to the surface.

Figure 5:
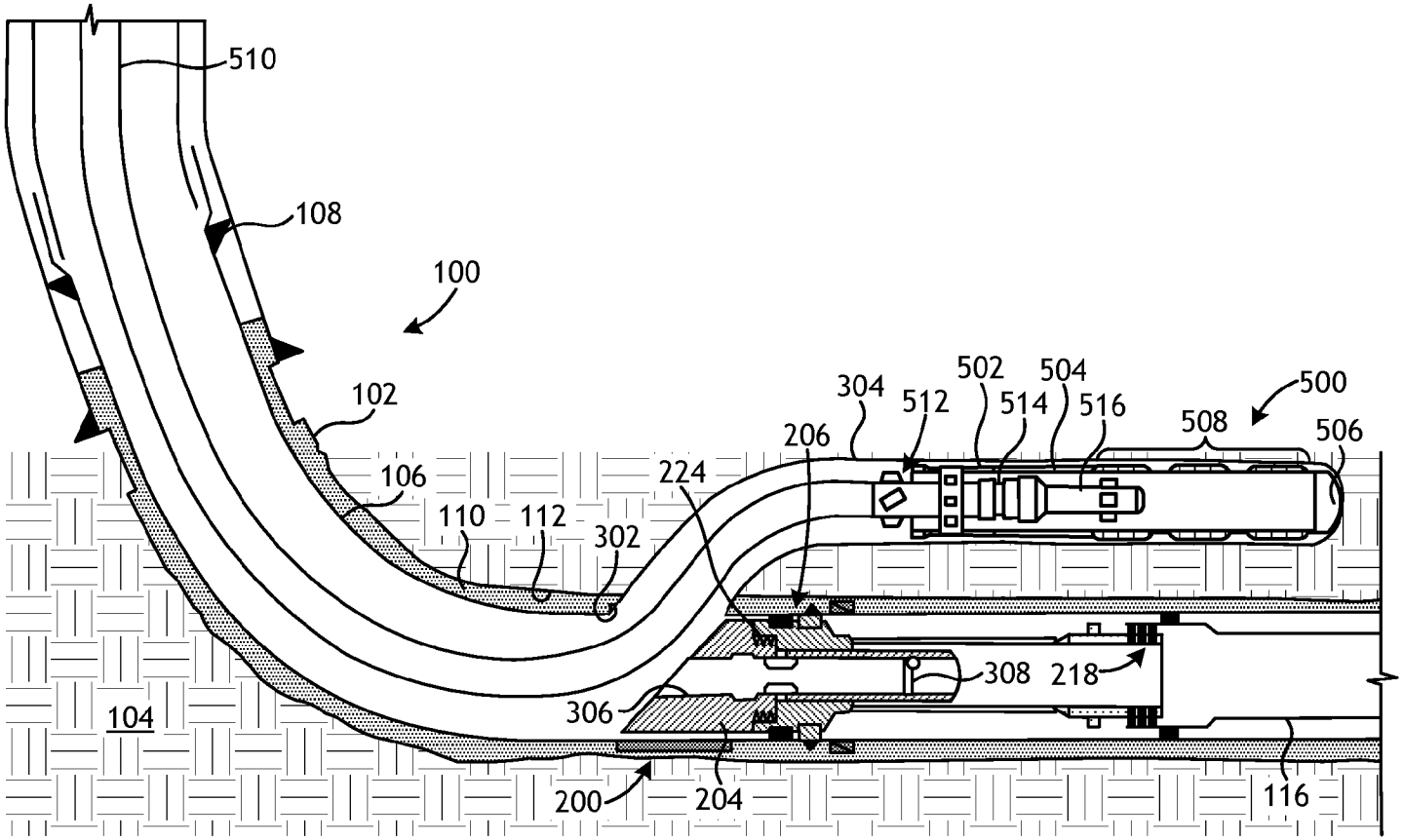
FIG. 5 depicts a lateral completion being installed in the lateral wellbore.

Referring now to FIG. 5, a lateral completion 500 is depicted as being installed in the lateral wellbore 304. As illustrated, the lateral completion 500 may include several components, such as a lateral liner top 502, one or more lateral liner joints 504 extending from the liner top 502, a bullnose 506, and one or more completion tools 508 axially interposing the liner joints 504 and the bullnose 506. The completion tools 508 may include any wellbore completion device or component that may be used to regulate and/or control production flow from the formation 104 including, but not limited to, well screens, slotted liners, perforated liners, wellbore packers, inflow control devices, valves, chokes, sliding sleeves, etc.

The lateral completion 500 may be conveyed into the lateral wellbore 304 as coupled to a work string 510. More particularly, the work string 510 may include a liner running tool 512 that attaches to the lateral completion 500 at the liner top 502. In the illustrated embodiment, the liner running tool 512 is depicted as being received at least partially into the liner top 502, but could alternatively be coupled to the outside of the liner top 502, without departing from the scope of the disclosure. Similar to the drill bit 402 (FIG. 4), the bullnose 506 may exhibit a diameter that is greater than the diameter of the whipstock bore 306 of the whipstock 204. As a result, as the lateral completion 500 is run into the parent wellbore 102 on the work string 510, the lateral completion 500 may be forced to ride up the ramped surface of the whipstock 402, through the casing exit 302, and into the lateral wellbore 304 where it may be deployed according to known wellbore completion deployment methods.

Once the lateral completion 500 is suitably deployed within the lateral wellbore 304, the work string 510 may be detached from the lateral completion 500. In at least one embodiment, the liner running tool 512 may include a valve assembly 514 configured to facilitate detachment (e.g., hydraulic release) of the liner running tool 512 from the liner top 502. Once the liner running tool 512 is detached from the liner top 502, the work string 510 may be retracted and thereby expose a whipstock retrieval tool 516 operatively coupled to the work string 510 via the liner running tool 512.

Figure 6:
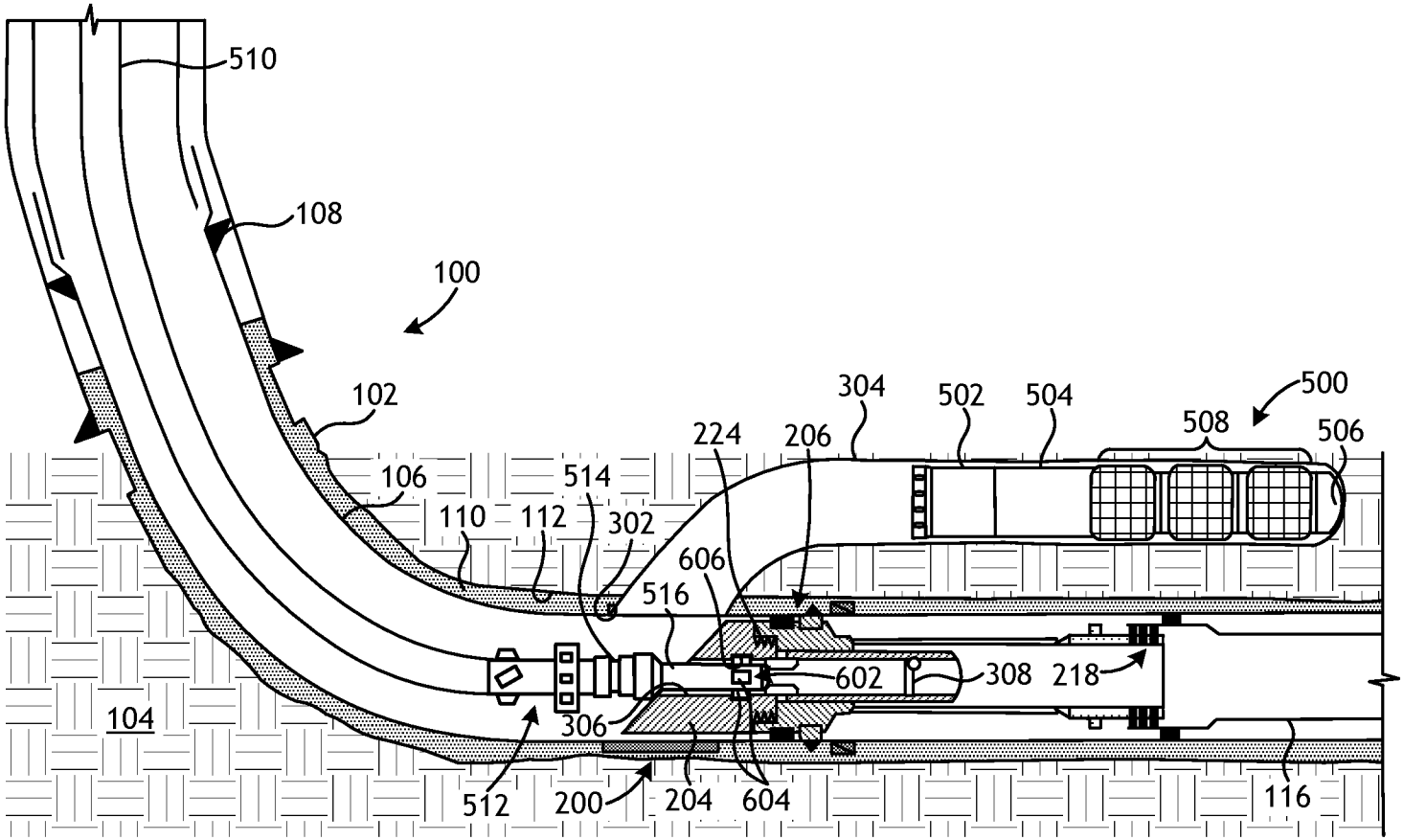
FIG. 6 depicts a whipstock retrieval tool engaging and removing a whipstock from a latch anchor.

Referring now to FIG. 6, upon release of the liner running tool 512 from the lateral completion 500, the work string 510 may then be pulled back into the parent wellbore 102 and subsequently advanced downhole (i.e., to the right in FIG. 6) until the whipstock retrieval tool 516 is received into the whipstock bore 306 of the whipstock 204. The whipstock retrieval tool 516 may be coupled or otherwise secured to the whipstock 204 within the whipstock bore 306 via a coupling engagement 602. The coupling engagement 602 may comprise a variety of coupling mechanisms or methods capable of securing the whipstock retrieval tool 516 to the whipstock 204. In one embodiment, for instance, the coupling engagement 602 may include one or more dogs 604 disposed about the whipstock retrieval tool 516 and configured to locate and engage a whipstock profile 606 defined on the inner surface of the whipstock bore 306. In at least one embodiment, the dogs 604 may be actuatable (e.g., mechanically, electromechanically, hydraulically, pneumatically, etc.), but may alternatively be spring-loaded. In other embodiments, the coupling engagement 602 may comprise a collet or the like.

Once the whipstock retrieval tool 516 is suitably secured to the whipstock 204, the work string 510 may then be pulled in the uphole direction (i.e., toward the surface of the well) to separate the whipstock 204 from the latch anchor 206, which remains firmly secured within the parent wellbore 102. More particularly, pulling on the work string 510 in the uphole direction will place an axial load on the releasable connection 224 that eventually overcomes the engagement force provided or otherwise generated by the releasable connection 224. Upon overcoming the engagement force, the whipstock 204 may then be separated from the latch anchor 206 and retrieved to the surface as coupled to the work string 510. Removing the whipstock 204 from the latch anchor 206 exposes a portion of the releasable connection 224, which may now be able to receive and otherwise couple to other downhole tools or devices included in the assembly 200.

Figure 7:
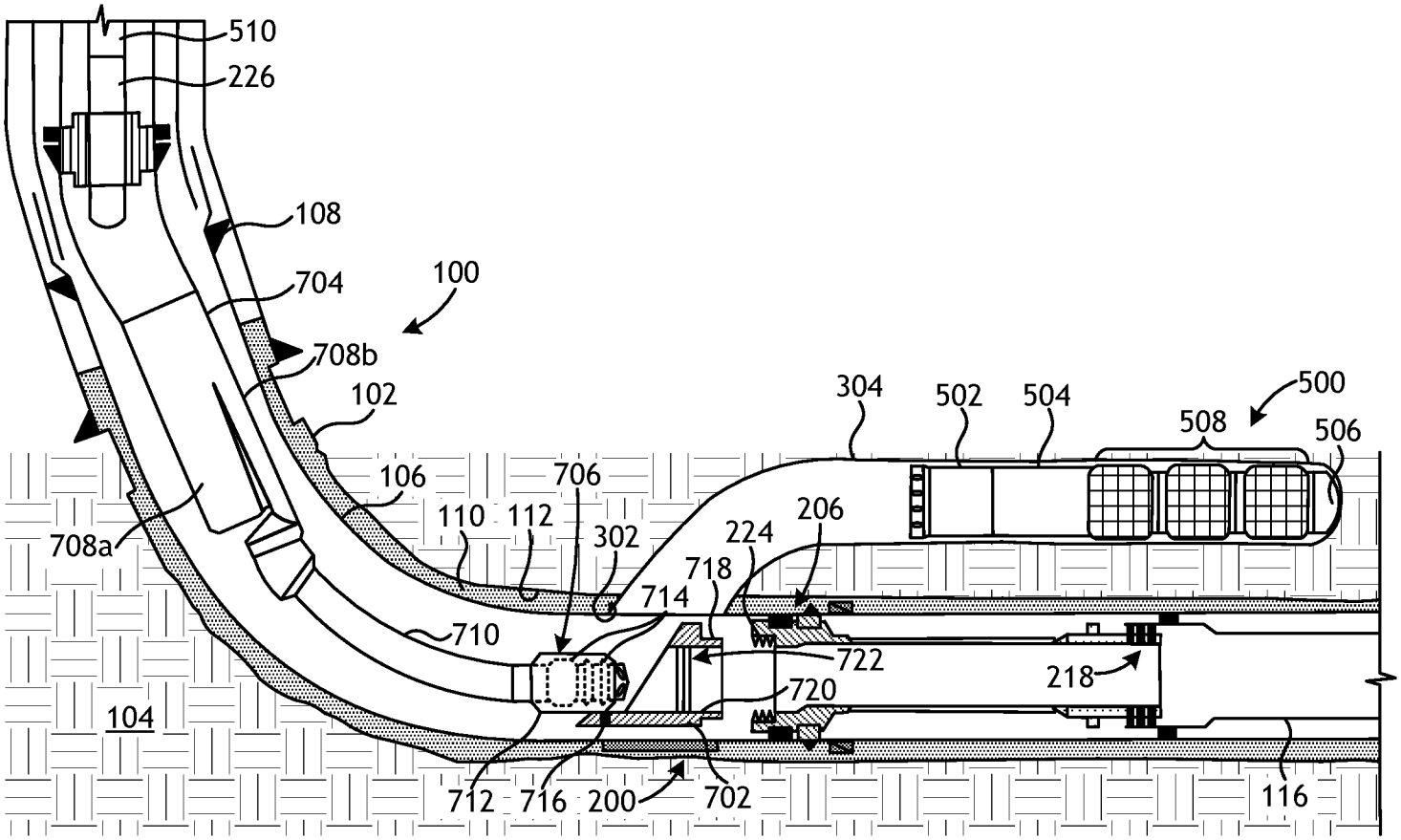
FIG. 7 depicts a completion deflector being conveyed into the parent wellbore.

Referring to FIG. 7, after removing the whipstock 204 from the parent wellbore 102, a completion deflector 702 may be conveyed into the parent wellbore 102 and coupled to the latch anchor 206 at the releasable connection 224. More particularly, the completion deflector 702 may be conveyed into the parent wellbore 102 as operatively coupled to the work string 510. As used herein, the term "operatively coupled" refers to a direct or indirect coupling engagement between two components such that movement of a first component (i.e., the work string 510) correspondingly moves the second component (i.e., the completion deflector 702).

In the illustrated embodiment, the completion deflector 702 is operatively coupled to the work string 510 via a multilateral junction 704 and a lateral stinger 706 that each interposes the completion deflector 702 and the work string 510. Once properly installed in the well system 100, the multilateral junction 704 may be configured to provide access to lower portions of the parent wellbore 102 via a primary leg **708*a* and access to the lateral wellbore 304 via a lateral leg 708*b***.

The lateral stinger 706 may include a stinger member 710 that is coupled to and extends from the lateral leg **708*b*, a shroud 712 positioned at a distal end of the stinger member 710, and one or more stinger seals 714 arranged within the shroud 712. In some embodiments, the shroud 712 may be coupled to the completion deflector 702 with one or more shear pins 716 or a similar mechanical fastener. In other embodiments, the shroud 712 may be coupled to the completion deflector 702** using other types of mechanical or hydraulic coupling mechanisms.

The completion deflector 702 may include or otherwise provide a mating interface 718 configured to locate and mate with the releasable connection 224 of the latch anchor 206. Attaching the mating interface 718 to the releasable connection 224 also serves to angularly pre-orient the completion deflector 702 relative to the casing exit 302 prior to full connection occurring. As illustrated, the completion deflector 702 may define and otherwise provide a deflector bore 720, and one or more seals 722 may be arranged within the deflector bore 720 to seal against the primary leg 708*a*, as described below.

Once the completion deflector 702 is properly connected to the latch anchor 206, the work string 510 may be detached from the completion deflector 702 at the lateral stinger 706 and, more particularly, at the shroud 712. This may be accomplished by placing an axial load on the lateral stinger 706 via the work string 510 and shearing the shear pin(s) 716 that connect the lateral stinger 706 to the completion deflector 702. Once the shear pin(s) 716 fail, the lateral stinger 706 may then be free to move with respect to the completion deflector 702 as manipulated by axial movement of the work string 510. More particularly, with the completion deflector 702 connected to the latch anchor 206 and the lateral stinger 706 detached from the completion deflector 702, the work string 510 may be advanced downhole within the parent wellbore 102 to position the lateral leg 708*g* and the lateral stinger 706 within the lateral wellbore 304. A diameter of the deflector bore 720 may be smaller than a diameter of the shroud 712, whereby the lateral stinger 706 is prevented from entering the deflector bore 720 but the shroud 712 is instead forced to ride up the ramped surface of the completion deflector 702 and into the lateral wellbore 304.

Figure 8:
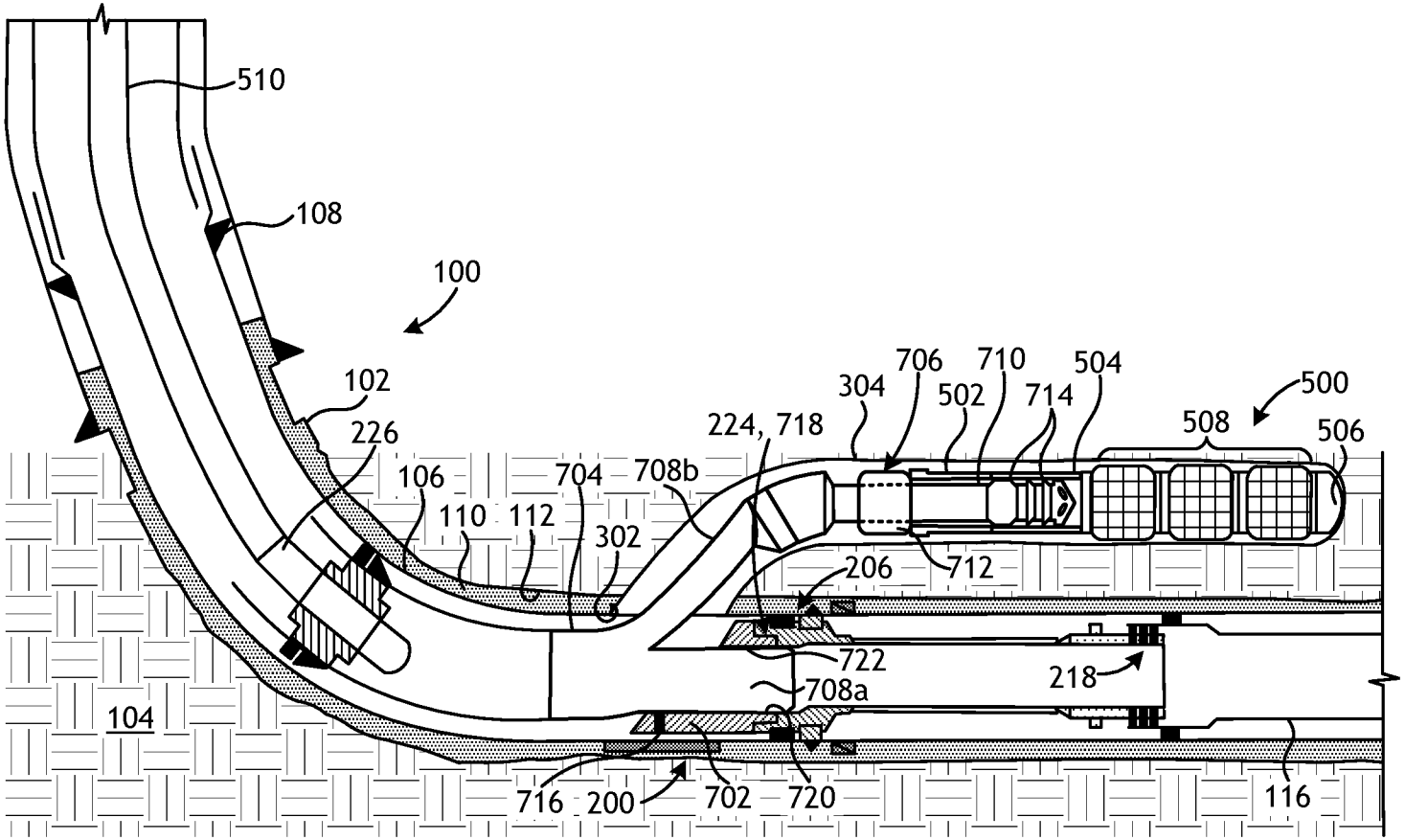
FIG. 8 depicts a lateral stinger and a lateral leg of a multilateral junction being advanced into the lateral wellbore.

Referring to FIG. 8, the lateral stinger 706 and the lateral leg 708*b* of the multilateral junction 704 are depicted as being advanced into the lateral wellbore 304. As the lateral stinger 706 advances within the lateral wellbore 304, the shroud 712 eventually engages the liner top 502 of the lateral completion 500. The diameter of the shroud 712 may be greater than a diameter of the liner top 502 and, as a result, the shroud 712 may be prevented from entering the liner top 502. Upon engaging the liner top 502, weight may then be applied to the lateral stinger 706 via the work string 510, which may result in the shroud 712 detaching from the distal end of the stinger member 710. In some embodiments, for instance, one or more shear pins or other shearable devices (not shown) may be used to couple the shroud 712 to the distal end of the stinger member 710, and the applied axial load may surpass a shear limit of the shear pins, thereby releasing the shroud 712 from the stinger member 710.

With the shroud 712 released from the stinger member 710, the work string 510 may be advanced further such that the shroud 712 slides along the outer surface of the stinger member 710 as the stinger member 710 advances into the liner top 510 where the stinger seals 714 sealingly engage the inner wall of the liner top 510. With the stinger seals 714 sealed against the liner top 510, fluid communication may be facilitated through the lateral wellbore 304, including through the various components of the lateral completion 500.

Advancing the work string 510 downhole within the parent wellbore 102 may also advance the primary leg 708*a* until locating and being received within the deflector bore 720. The seals 722 in the deflector bore 720 may sealingly engage the outer surface of the primary leg 708*a* and thereby provide a sealed interface that facilitates fluid communication from upper portions of the parent wellbore 102 into the lower liner 116 and otherwise into lower portions of the parent wellbore 102.

Figure 9A:
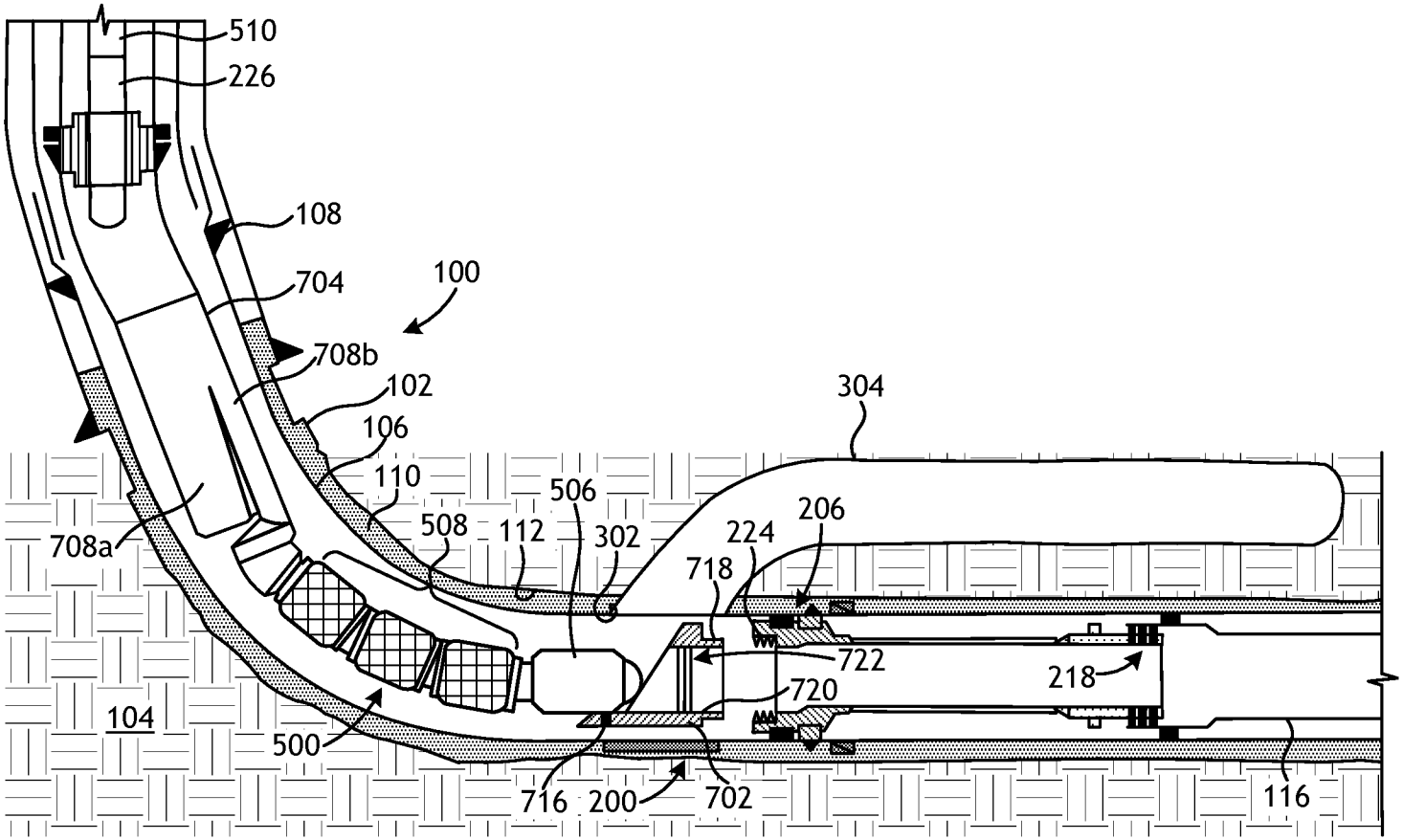
FIGS. 9A and 9B depict an alternative embodiment in constructing the well system of FIGS. 1-8.
Figure 9B:
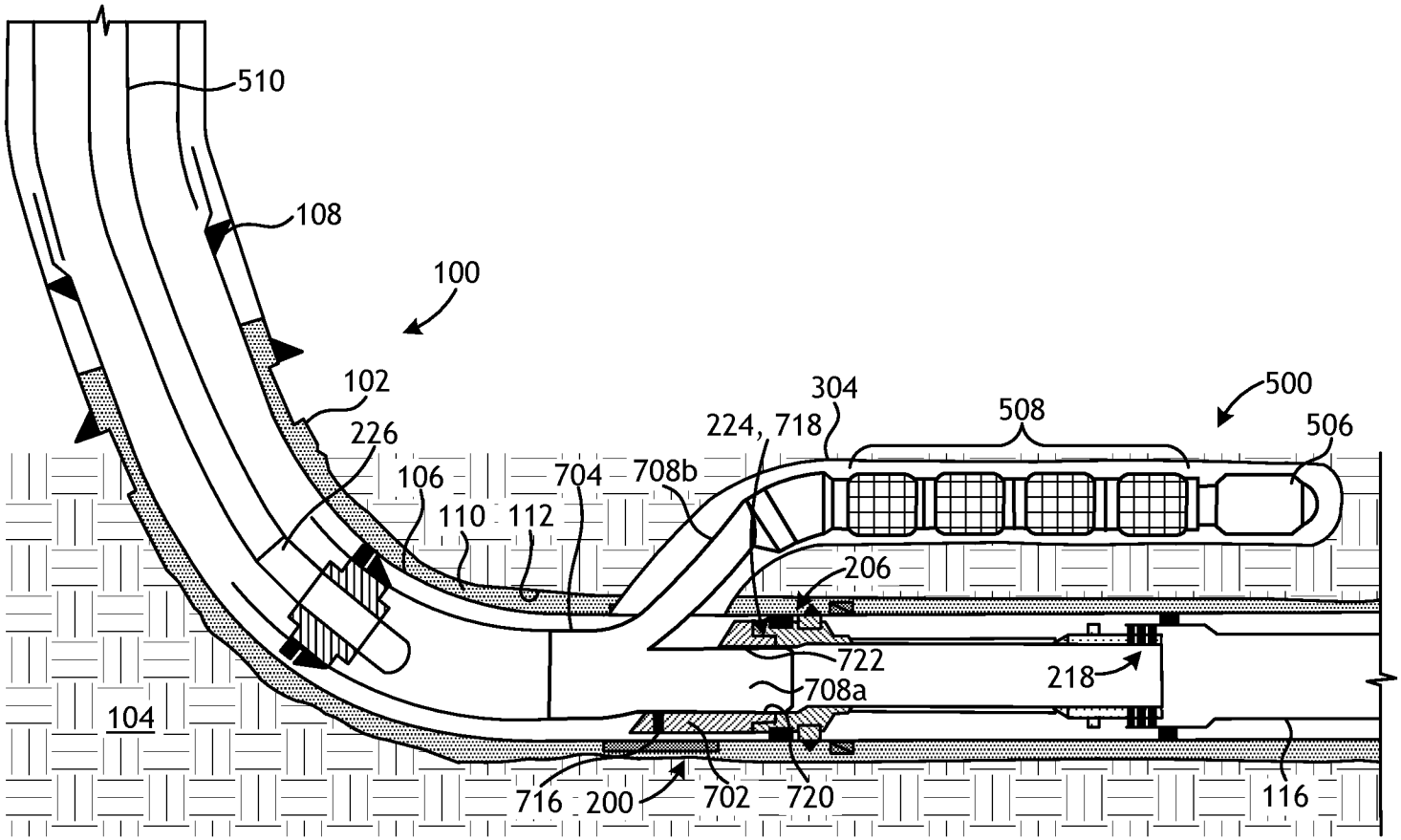

Referring now to FIGS. 9A and 9B, with continued reference to the prior figures, illustrated is an alternative embodiment in constructing the well system 100, according to one or more embodiments. More particularly, FIGS. 9A and 9B depict the assembly 200 where completion deflector 702 is run into the parent wellbore 102 simultaneously with the completion 500 and the multilateral junction 704. As illustrated, the completion deflector 702 may be conveyed into the parent wellbore 102 as operatively coupled to the work string 510, where the multilateral junction 704 and the lateral completion 500 each interpose the completion deflector 702 and the work string 510. The bullnose 506 of the lateral completion 500 may be coupled to the completion deflector 702, such as via the shear pin(s) 716.

As the work string 510 moves the completion deflector 702 downhole within the parent wellbore 102, the mating interface 718 will eventually locate and mate with the releasable connection 224 of the latch anchor 206, and thereby secure the completion deflector 702 to the latch anchor 206. Once the completion deflector 702 is properly coupled to the latch anchor 206, the work string 510 may then be detached from the completion deflector 702 at the bullnose 506. This may be accomplished by placing an axial load on the bullnose 506 via the work string 510 and shearing the shear pin(s) 716 that couples the bullnose 506 to the completion deflector 702. Once the shear pin(s) 716 fails, the bullnose 506 may then be free to move with respect to the completion deflector 702, and the work string 510 may be advanced downhole within the parent wellbore 102 to position the lateral completion 500 within the lateral wellbore 304. The bullnose 506 may exhibit a diameter that is greater than the diameter of the deflector bore 720 and, as a result, the bullnose 506 may be forced to ride up the ramped surface of the completion deflector 702, through the casing exit 302, and into the lateral wellbore 304 where the lateral completion 500 may be deployed according to known wellbore completion deployment methods.

FIG. 9B depicts the lateral completion 500 and the lateral leg 708*b* of the multilateral junction 704 as advanced into the lateral wellbore 304. The lateral leg 708*b* may provide fluid communication between the parent wellbore 102 and the lateral wellbore 304, including through the various components of the lateral completion 500. Advancing the work string 510 downhole within the parent wellbore 102 may also advance the primary leg 708*a* until locating and being received within the deflector bore 720. The seals 722 in the deflector bore 720 may sealingly engage the outer surface of the primary leg 708*a* and thereby provide a sealed interface that facilitates fluid communication from upper portions of the parent wellbore 102 into the lower liner 116 and otherwise into lower portions of the parent wellbore 102.

Figure 10A:
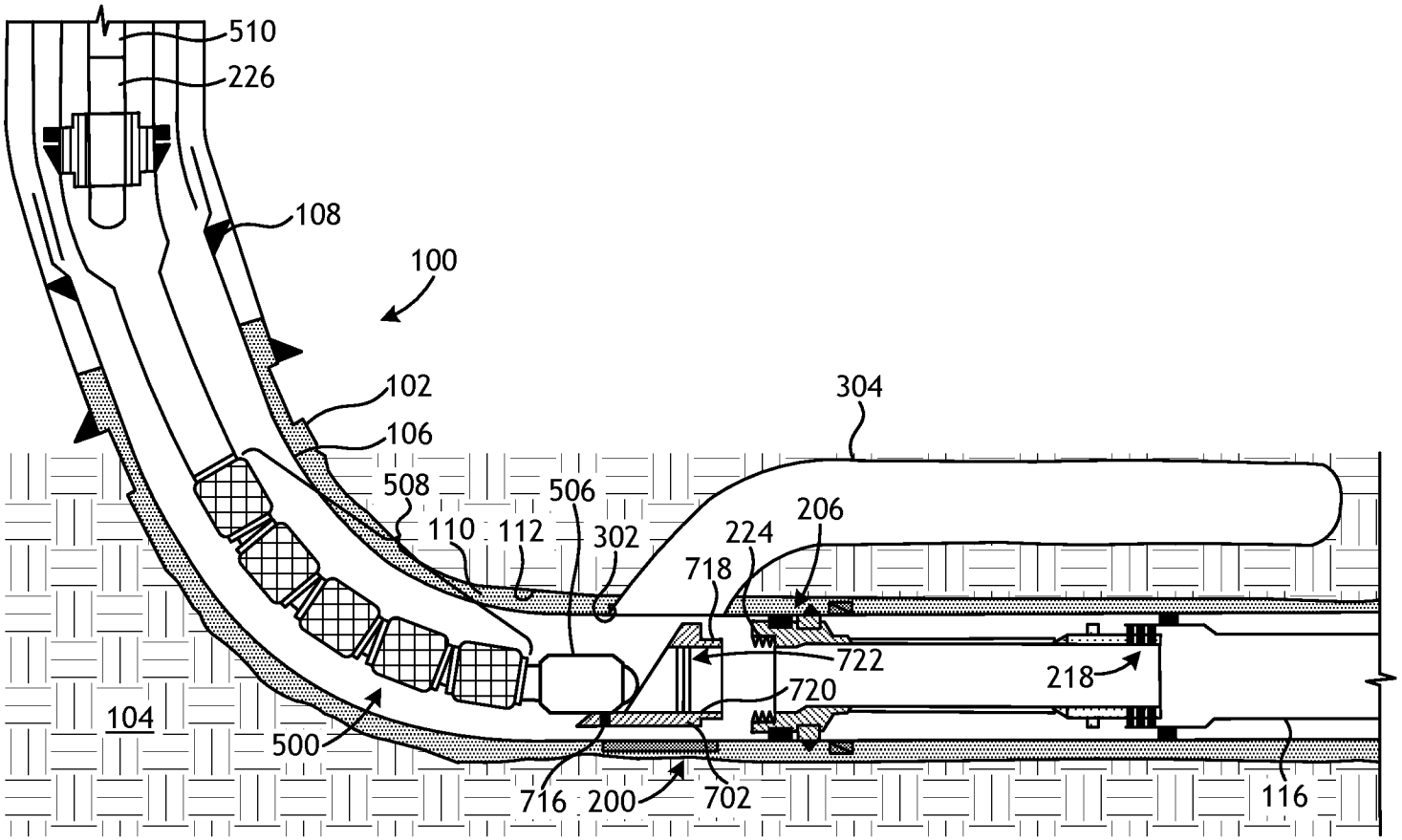
FIGS. 10A and 10B depict another alternative embodiment in constructing the well system of FIGS. 1-8.
Figure 10B:
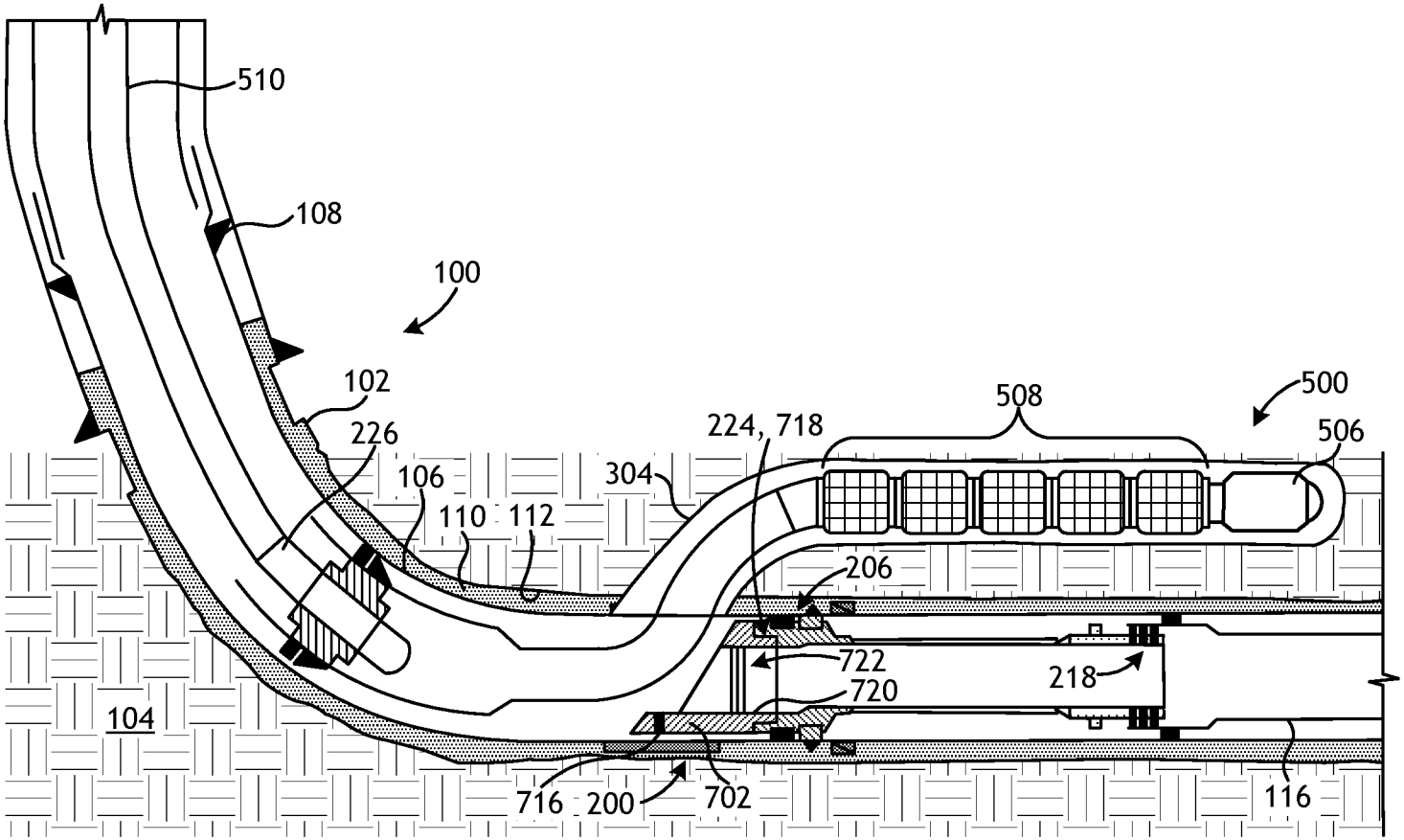

Referring now to FIGS. 10A and 10B, with continued reference to the prior figures, illustrated is another alternative embodiment in constructing the well system 100, according to one or more embodiments. More particularly, FIGS. 10A and 10B depict the assembly 200 where completion deflector 702 is run into the parent wellbore 102 simultaneously with the completion 500. As illustrated, the completion deflector 702 may be conveyed into the parent wellbore 102 as operatively coupled to the work string 510 via the lateral completion 500. Again, the bullnose 506 of the lateral completion 500 may be coupled to the completion deflector 702, such as via the shear pin(s) 716.

As the work string 510 moves the completion deflector 702 downhole within the parent wellbore 102, the mating interface 718 eventually locates and mates with the releasable connection 224 of the latch anchor 206, and thereby secures the completion deflector 702 to the latch anchor 206. Once the completion deflector 702 is properly coupled to the latch anchor 206, the work string 510 may then be detached from the completion deflector 702 at the bullnose 506. As indicated above, this may be accomplished by placing an axial load on the bullnose 506 via the work string 510 and shearing the shear pin(s) 716 that couples the bullnose 506 to the completion deflector 702. Once the shear pin(s) 716 fails, the bullnose 506 may then be free to move with respect to the completion deflector 702, and the work string 510 may be advanced downhole within the parent wellbore 102 to position the lateral completion 500 within the lateral wellbore 304. Again, the diameter of the bullnose 506 prevents the bullnose 506 from entering the deflector bore 720 but is instead forced to ride up the ramped surface of the completion deflector 702, through the casing exit 302, and into the lateral wellbore 304 where the lateral completion 500 may be deployed. FIG. 10B depicts the lateral completion 500 as advanced into and deployed within the lateral wellbore 304.

Figure 11:
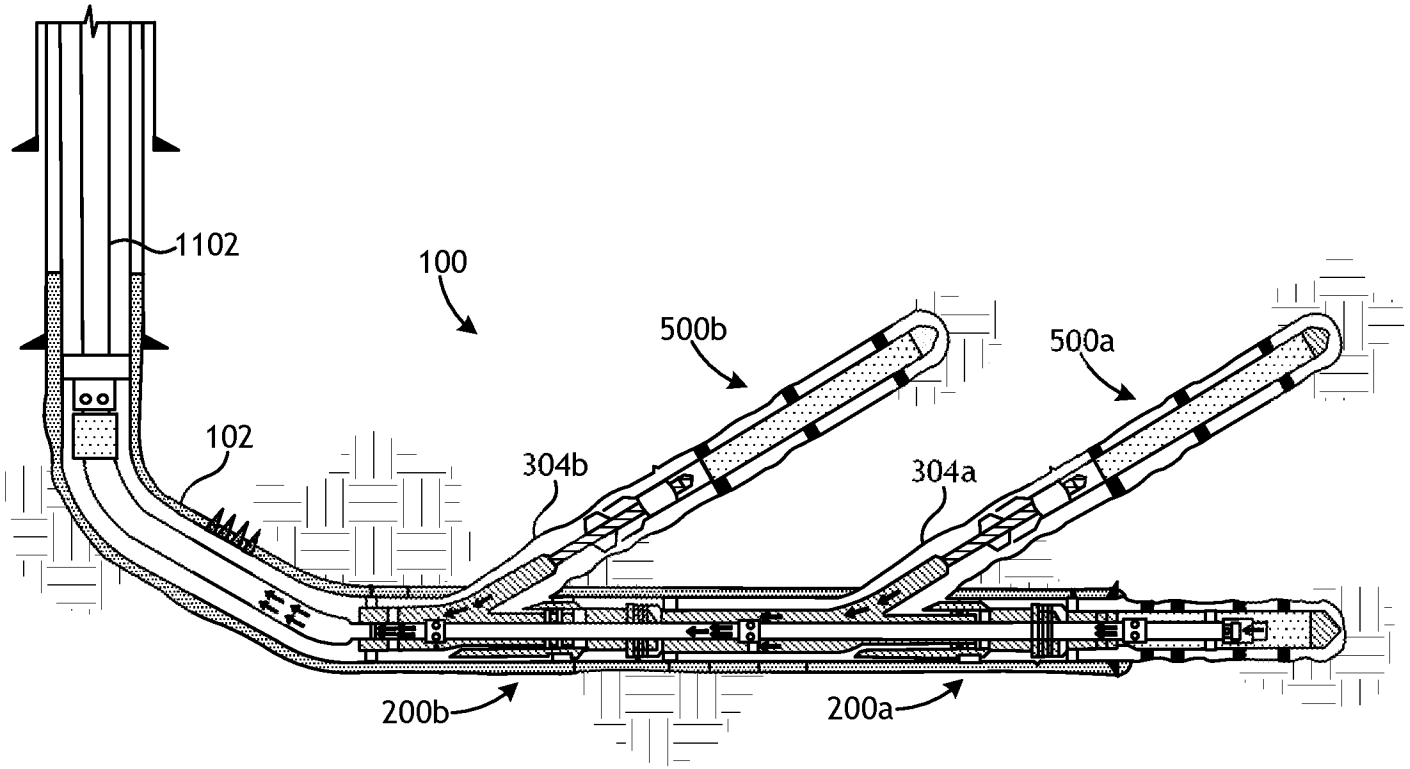
FIG. 11 depicts the well system of FIGS. 1-8 as having multiple lateral wellbores extending from the parent wellbore.

Referring now to FIG. 11, with continued reference to the prior figures, illustrated is the well system 100 having multiple lateral wellbores 304 extending from the parent wellbore 102, according to one or more embodiments. The process of installing the assembly 200 into the well system 100 may be repeated as multiple locations along the parent wellbore 102. As illustrated, the well system 100 is depicted as including at least two lateral wellbores 304, shown as a first lateral wellbore 304*a* and a second lateral wellbore 304*b*, where each lateral wellbore 304*a,b* extends from the parent wellbore 102 at distinct locations. Each lateral wellbore 304*a,b* may further have a lateral completion 500 deployed therein, shown as a first lateral completion 500*a* in the first lateral wellbore 304*a* and a second lateral completion 500*b* in the second lateral wellbore 304*b*.

The assembly 200 as generally described herein may be deployed and otherwise constructed at the junction of each lateral wellbore 304*a,b*. More specifically, a first assembly 200*a* is shown as constructed at the junction of the parent wellbore 102 and the first lateral wellbore 304*a*, and a second assembly 200*b* is shown as constructed at the junction of the parent wellbore 102 and the second lateral wellbore 304*b*. As will be appreciated, the first assembly 200*a* may be constructed prior to the second assembly 200*b*, and each assembly 200*a,b* may be constructed as described herein above. A common production tubing 1102 may tie into each assembly 200*a,b* to convey fluids extracted from the surrounding formations to the surface. Moreover, it will further be appreciated that additional junctions and assemblies 200 may be constructed in the well system 100, without departing from the scope of the disclosure.

Embodiments disclosed herein include:

A. A method that includes conveying a whipstock and a latch anchor into a parent wellbore, the latch anchor being attached to the whipstock at a releasable connection and the parent wellbore being lined at least partially with casing that includes a latch coupling, securing the latch anchor within the parent wellbore by mating a latch profile of the latch anchor with the latch coupling, drilling a lateral wellbore that extends from the parent wellbore, separating the whipstock from the latch anchor at the releasable connection with a whipstock retrieval tool and thereby exposing a portion of the releasable connection, removing the whipstock from the parent wellbore with the whipstock retrieval tool, and conveying a completion deflector into the parent wellbore and attaching the completion deflector to the latch anchor at the releasable connection.

B. A well system that includes a parent wellbore lined at least partially with casing that includes a latch coupling, a lateral wellbore that extends from the parent wellbore at a casing exit, a whipstock and a latch anchor conveyable into the parent wellbore on a first run, the latch anchor being attached to the whipstock at a releasable connection and including a latch profile matable with the latch coupling to secure the latch anchor within the parent wellbore on the first run, and a completion deflector conveyable into the parent wellbore on a second run after the whipstock has been detached from the latch anchor and removed from the parent wellbore, wherein detaching the whipstock from the latch anchor exposes the releasable connection and the completion deflector provides a mating interface matable with the releasable connection.

C. An assembly that includes a whipstock defining an inner bore, a latch anchor coupled to the whipstock at a releasable connection and including a latch profile that is matable with a latch coupling included in casing that lines a parent wellbore, wherein mating the latch profile to the latch coupling secures the latch anchor within the parent wellbore, a whipstock retrieval tool receivable within the inner bore to engage and detach the whipstock from the latch anchor, wherein detaching the whipstock from the latch anchor exposes the releasable connection, and a completion deflector conveyable into the parent wellbore after the whipstock has been detached from the latch anchor and removed from the parent wellbore, the completion deflector providing a mating interface matable with the releasable connection.

Each of embodiments A, B, and C may have one or more of the following additional elements in any combination: Element 1: wherein the completion deflector includes a mating interface and attaching the completion deflector to the latch anchor at the releasable connection comprises mating the mating interface with the releasable connection. Element 2: wherein separating the whipstock from the latch anchor at the releasable connection is preceded by conveying a lateral completion into the lateral wellbore on a liner running tool, the lateral completion including a liner top, a bullnose, and one or more completion tools axially interposing the liner top and the bullnose, detaching the liner running tool from the lateral completion and retracting the liner running tool into the parent wellbore, wherein the whipstock retrieval tool is operatively coupled to a distal end of the liner running tool, and receiving the whipstock retrieval tool in an inner bore of the whipstock and thereby coupling the whipstock retrieval tool to the whipstock. Element 3: wherein conveying the completion deflector into the parent wellbore comprises conveying the completion deflector into the parent wellbore as operatively coupled to a work string via a multilateral junction and a lateral stinger that each interpose the completion deflector and the work string, wherein the multilateral junction includes a primary leg and a lateral leg, and the lateral stinger includes a stinger member extending from the lateral leg and a shroud positioned at a distal end of the stinger member and coupled to the completion deflector, attaching the completion deflector to the latch anchor at the releasable connection, detaching the shroud from the completion deflector, and advancing the lateral stinger and the lateral leg into the lateral wellbore, and simultaneously advancing the primary leg into a deflector bore defined by the completion deflector. Element 4: wherein advancing the lateral stinger and the lateral leg into the lateral wellbore comprises engaging the shroud on the liner top, applying weight on the shroud via the work string and thereby detaching the shroud from the distal end of the stinger member, receiving the stinger member within an interior of the liner top, and sealingly engaging an inner wall of the liner top with one or more stinger seals disposed about the stinger member. Element 5: wherein conveying the completion deflector into the parent wellbore comprises conveying the completion deflector into the parent wellbore as operatively coupled to a work string via a multilateral junction and a lateral completion that each interpose the completion deflector and the work string, wherein the multilateral junction includes a primary leg and a lateral leg, and the lateral completion extends from the lateral leg and includes a bullnose coupled to the completion deflector, coupling the completion deflector to the latch anchor at the releasable connection, detaching the bullnose from the completion deflector, advancing the lateral completion and the lateral leg into the lateral wellbore, and simultaneously advancing the primary leg into a deflector bore of the completion deflector. Element 6: wherein conveying the completion deflector into the parent wellbore comprises conveying the completion deflector into the parent wellbore as operatively coupled to a work string via a lateral completion that interposes the completion deflector and the work string, wherein the lateral completion includes a bullnose coupled to the completion deflector, attaching the completion deflector to the latch anchor at the releasable connection, detaching the bullnose from the completion deflector, and advancing the lateral completion into the lateral wellbore.

Element 7: wherein the releasable connection is selected from the group consisting of a collet, a latching profile, a threaded engagement, and any combination thereof. Element 8: further comprising a liner running tool that conveys a lateral completion into the lateral wellbore, the lateral completion including a liner top, a bullnose, and one or more completion tools axially interposing the liner top and the bullnose, a whipstock retrieval tool operatively coupled to a distal end of the liner running tool, wherein the whipstock retrieval tool is exposed upon detaching the liner running tool from the lateral completion and retracting the liner running tool into the parent wellbore, and an inner bore defined in the whipstock to receive and attach to the whipstock retrieval tool such that the whipstock retrieval tool is able to retrieve the whipstock from the latch anchor connection. Element 9: further comprising a work string that conveys the completion deflector into the parent wellbore, a multilateral junction interposing the completion deflector and the work string and including a primary leg and a lateral leg, and a lateral stinger interposing the completion deflector and the work string and including a stinger member extending from the lateral leg and a shroud positioned at a distal end of the stinger member and coupled to the completion deflector, wherein, upon detaching the shroud from the completion deflector, the lateral stinger and the lateral leg are advanced into the lateral wellbore, and the primary leg is simultaneously advanced into a deflector bore defined by the completion deflector. Element 10: further comprising one or more stinger seals disposed about the stinger member and enclosed by the shroud, wherein the shroud is detached from the stinger member upon engaging the liner top and the stinger member is received within an interior of the liner top where the one or more stinger seals sealingly engage an inner wall of the liner top. Element 11: further comprising a work string that conveys the completion deflector into the parent wellbore, a multilateral junction interposing the completion deflector and the work string and including a primary leg and a lateral leg, and a lateral completion interposing the completion deflector and the work string and extending from the lateral leg, the lateral completion including a bullnose coupled to the completion deflector, wherein, upon detaching the bullnose from the completion deflector, the lateral completion and the lateral leg are advanced into the lateral wellbore, and the primary leg is simultaneously advanced into a deflector bore defined by the completion deflector. Element 12: further comprising a work string that conveys the completion deflector into the parent wellbore, a lateral completion interposing the completion deflector and the work string and including a bullnose coupled to the completion deflector, wherein, upon detaching the bullnose from the completion deflector, the lateral completion is advanced into the lateral wellbore.

Element 13: wherein the releasable connection is selected from the group consisting of a collet, a latching profile, a threaded engagement, and any combination thereof. Element 14: further comprising a liner running tool that conveys a lateral completion into a lateral wellbore that extends from the parent wellbore, the lateral completion including a liner top, a bullnose, and one or more completion tools axially interposing the liner top and the bullnose, wherein the whipstock retrieval tool is operatively coupled to a distal end of the liner running tool and the whipstock retrieval tool is exposed upon detaching the liner running tool from the lateral completion and retracting the liner running tool into the parent wellbore. Element 15: further comprising a work string that conveys the completion deflector into the parent wellbore, a multilateral junction interposing the completion deflector and the work string and including a primary leg and a lateral leg, and a lateral stinger interposing the completion deflector and the work string and including a stinger member extending from the lateral leg and a shroud positioned at a distal end of the stinger member and coupled to the completion deflector, wherein, upon detaching the shroud from the completion deflector, the lateral stinger and the lateral leg are advanced into the lateral wellbore, and the primary leg is simultaneously advanced into a deflector bore defined by the completion deflector. Element 16: further comprising one or more stinger seals disposed about the stinger member and enclosed by the shroud, wherein the shroud is detached from the stinger member upon engaging the liner top and the stinger member is received within an interior of the liner top where the one or more stinger seals sealingly engage an inner wall of the liner top.

By way of non-limiting example, exemplary combinations applicable to A, B, and C include: Element 2 with Element 3; Element 3 with Element 4; Element 8 with Element 9; Element 9 with Element 10; and Element 15 with Element 16.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A method, comprising:

conveying a whipstock and a latch anchor into a parent wellbore, the latch anchor being attached to the whipstock at a releasable connection and the parent wellbore being lined at least partially with casing that includes a latch coupling;

securing the latch anchor within the parent wellbore by mating a latch profile of the latch anchor with the latch coupling;

deflecting a drill bit with the whipstock to drill a lateral wellbore that extends from the parent wellbore;

conveying a lateral completion into the lateral wellbore on a liner running tool, the lateral completion including a completion tool;

separating the whipstock from the latch anchor at the releasable connection with a whipstock retrieval tool and thereby exposing a portion of the releasable connection, wherein the whipstock retrieval tool is operatively coupled to a distal end of the liner running tool;

removing the whipstock from the parent wellbore with the whipstock retrieval tool; and conveying a completion deflector into the parent wellbore, the completion deflector being operatively coupled to a work string, and attaching the completion deflector to the latch anchor at the releasable connection.

2. The method of claim 1, wherein the completion deflector includes a mating interface and attaching the completion deflector to the latch anchor at the releasable connection comprises mating the mating interface with the releasable connection.

3. The method of claim 1, wherein the lateral completion further includes a liner top and a bullnose, and the completion tool axially interposed between the liner top and the bullnose, and wherein separating the whipstock from the latch anchor at the releasable connection is preceded by:

detaching the liner running tool from the lateral completion and retracting the liner running tool into the parent wellbore, wherein the whipstock retrieval tool is operatively coupled to a distal end of the liner running tool; and receiving the whipstock retrieval tool in an inner bore of the whipstock and thereby coupling the whipstock retrieval tool to the whipstock.

4. The method of claim 3, wherein conveying the completion deflector into the parent wellbore comprises:

conveying the completion deflector into the parent wellbore as operatively coupled to the work string via a multilateral junction and a lateral stinger that each interpose the completion deflector and the work string, wherein the multilateral junction includes a primary leg and a lateral leg, and the lateral stinger includes a stinger member extending from the lateral leg and a shroud positioned at a distal end of the stinger member and coupled to the completion deflector;

attaching the completion deflector to the latch anchor at the releasable connection;

detaching the shroud from the completion deflector; and advancing the lateral stinger and the lateral leg into the lateral wellbore, and simultaneously advancing the primary leg into a deflector bore defined by the completion deflector.

5. The method of claim 4, wherein advancing the lateral stinger and the lateral leg into the lateral wellbore comprises:

engaging the shroud on the liner top;

applying weight on the shroud via the work string and thereby detaching the shroud from the distal end of the stinger member;

receiving the stinger member within an interior of the liner top; and sealingly engaging an inner wall of the liner top with one or more stinger seals disposed about the stinger member.

6. The method of claim 1, wherein conveying the completion deflector into the parent wellbore comprises:

conveying the completion deflector into the parent wellbore as operatively coupled to the work string via a multilateral junction and a lateral stinger that each interpose the completion deflector and the work string, wherein the multilateral junction includes a primary leg and a lateral leg, and the lateral completion extends from the lateral leg and includes a bullnose coupled to the completion deflector;

coupling the completion deflector to the latch anchor at the releasable connection;

detaching the bullnose from the completion deflector; and advancing the lateral completion and the lateral leg into the lateral wellbore, and simultaneously advancing the primary leg into a deflector bore of the completion deflector.

7. The method of claim 1, wherein conveying the completion deflector into the parent wellbore comprises:

conveying the completion deflector into the parent wellbore as operatively coupled to the work string via the lateral completion, wherein the lateral completion interposes the completion deflector and the work string, and further includes a bullnose coupled to the completion deflector;

attaching the completion deflector to the latch anchor at the releasable connection;

detaching the bullnose from the completion deflector; and advancing the lateral completion into the lateral wellbore.

8. A well system, comprising:

a parent wellbore lined at least partially with casing that includes a latch coupling;

a lateral wellbore that extends from the parent wellbore at a casing exit;

a whipstock and a latch anchor conveyable into the parent wellbore on a first run, the latch anchor being attached to the whipstock at a releasable connection and including a latch profile matable with the latch coupling to secure the latch anchor within the parent wellbore on the first run;

a lateral completion configured to be conveyed into the lateral wellbore on a liner running tool, and including a completion tool; and a completion deflector operatively coupled to a work string, the completion deflector being conveyable into the parent wellbore on a second run after the whipstock has been detached from the latch anchor and removed from the parent wellbore, wherein a whipstock retrieval tool is operatively coupled to a distal end of the liner running tool, and wherein detaching the whipstock from the latch anchor exposes the releasable connection and the completion deflector provides a mating interface matable with the releasable connection.

9. The well system of claim 8, wherein the releasable connection is selected from the group consisting of a collet, a latching profile, a threaded engagement, and any combination thereof.

10. The well system of claim 8, further comprising:

a liner running tool that conveys the lateral completion into the lateral wellbore, the lateral completion further including a liner top and a bullnose, and the completion tool axially interposed between the liner top and the bullnose, wherein the whipstock retrieval tool is operatively coupled to a distal end of the liner running tool, and the whipstock retrieval tool is exposed upon detaching the liner running tool from the lateral completion and retracting the liner running tool into the parent wellbore; and an inner bore defined in the whipstock to receive and attach to the whipstock retrieval tool such that the whipstock retrieval tool is able to retrieve the whipstock from the releasable connection with the latch anchor.

11. The well system of claim 10, further comprising:

a multilateral junction interposing the completion deflector and the work string and including a primary leg and a lateral leg, wherein the work string conveys the completion deflector into the parent wellbore; and a lateral stinger interposing the completion deflector and the work string and including a stinger member extending from the lateral leg and a shroud positioned at a distal end of the stinger member and coupled to the completion deflector, wherein, upon detaching the shroud from the completion deflector, the lateral stinger and the lateral leg are advanced into the lateral wellbore, and the primary leg is simultaneously advanced into a deflector bore defined by the completion deflector.

12. The well system of claim 11, further comprising one or more stinger seals disposed about the stinger member and enclosed by the shroud, wherein the shroud is detached from the stinger member upon engaging the liner top and the stinger member is received within an interior of the liner top where the one or more stinger seals sealingly engage an inner wall of the liner top.

13. The well system of claim 8, further comprising:

a multilateral junction interposing the completion deflector and the work string and including a primary leg and a lateral leg, wherein the work string conveys the completion deflector into the parent wellbore, wherein the lateral completion interposes the completion deflector and the work string and extends from the lateral leg, the lateral completion further including a bullnose coupled to the completion deflector, and wherein, upon detaching the bullnose from the completion deflector, the lateral completion and the lateral leg are advanced into the lateral wellbore, and the primary leg is simultaneously advanced into a deflector bore defined by the completion deflector.

14. The well system of claim 8, wherein:

the work string conveys the completion deflector into the parent wellbore;

the lateral completion interposes the completion deflector and the work string and further includes a bullnose coupled to the completion deflector; and upon detaching the bullnose from the completion deflector, the lateral completion is advanced into the lateral wellbore.

15. A whipstock and deflector assembly, comprising:

a whipstock defining an inner bore;

a latch anchor coupled to the whipstock at a releasable connection and including a latch profile that is matable with a latch coupling included in casing that lines a parent wellbore, wherein mating the latch profile to the latch coupling secures the latch anchor within the parent wellbore;

a lateral completion configured to be conveyed into a lateral wellbore that extends from the parent wellbore on a liner running tool, the lateral completion including a completion tool;

a whipstock retrieval tool receivable within the inner bore to engage and detach the whipstock from the latch anchor, wherein the whipstock retrieval tool is operatively coupled to a distal end of the liner running tool, and detaching the whipstock from the latch anchor exposes the releasable connection; and a completion deflector conveyable into the parent wellbore after the whipstock has been detached from the latch anchor and removed from the parent wellbore, the completion deflector being operatively coupled to a work string and providing a mating interface matable with the releasable connection.

16. The whipstock and deflector assembly of claim 15, wherein the releasable connection is selected from the group consisting of a collet, a latching profile, a threaded engagement, and any combination thereof.

17. The whipstock and deflector assembly of claim 15, wherein the liner running tool conveys the lateral completion into the lateral wellbore, the lateral completion further including a liner top and a bullnose, the completion tool axially interposed between the liner top and the bullnose, and wherein the whipstock retrieval tool is operatively coupled to a distal end of the liner running tool and the whipstock retrieval tool is exposed upon detaching the liner running tool from the lateral completion and retracting the liner running tool into the parent wellbore.

18. The whipstock and deflector assembly of claim 17, further comprising:

a multilateral junction interposing the completion deflector and the work string and including a primary leg and a lateral leg, wherein the work string conveys the completion deflector into the parent wellbore; and a lateral stinger interposing the completion deflector and the work string and including a stinger member extending from the lateral leg and a shroud positioned at a distal end of the stinger member and coupled to the completion deflector, wherein, upon detaching the shroud from the completion deflector, the lateral stinger and the lateral leg are advanced into the lateral wellbore, and the primary leg is simultaneously advanced into a deflector bore defined by the completion deflector.

19. The whipstock and deflector assembly of claim 18, further comprising one or more stinger seals disposed about the stinger member and enclosed by the shroud, wherein the shroud is detached from the stinger member upon engaging the liner top and the stinger member is received within an interior of the liner top where the one or more stinger seals sealingly engage an inner wall of the liner top.

* * * * *